US009259082B2

(12) United States Patent
Barre et al.

(10) Patent No.: US 9,259,082 B2
(45) Date of Patent: Feb. 16, 2016

(54) HANGING CLOSET ORGANIZER WITH RIGID ADJUSTABLE SHELVES

(71) Applicant: Neatfreak Group Inc., Mississauga (CA)

(72) Inventors: Bertrand Barre, Lapeyrouse (FR); Francis Lepage, Dommartin (FR)

(73) Assignee: NEATFREAK GROUP INC., Mississauga, Ontario (CA)

( * ) Notice: Subject to any disclaimer, the term of this patent is extended or adjusted under 35 U.S.C. 154(b) by 6 days.

(21) Appl. No.: 14/036,981

(22) Filed: Sep. 25, 2013

(65) Prior Publication Data

US 2015/0083682 A1 Mar. 26, 2015

(51) Int. Cl.

| | |
|---|---|
| ***A47F 5/00*** | (2006.01) |
| ***A47F 5/08*** | (2006.01) |
| ***A47F 7/00*** | (2006.01) |

(Continued)

(52) U.S. Cl.

CPC ..... *A47B 43/003* (2013.01); *A47B 43/04* (2013.01); *A47B 57/20* (2013.01); *A47B 57/406* (2013.01); *A47B 61/003* (2013.01); *A47B 61/04* (2013.01); *A47B 61/06* (2013.01); *A47B 73/006* (2013.01); *A47F 5/08* (2013.01); *A47F 5/0892* (2013.01); *A47B 57/16* (2013.01)

(58) Field of Classification Search

CPC ..... A47F 5/112; A47F 5/0006; A47F 5/0018; A47F 5/08; A47F 5/0807; A47F 5/0892; A47F 5/10; A47F 7/08; A47F 7/19; A47F 7/24; A47G 29/08; A47G 25/005; A47G 25/746; A47G 25/06; A47G 29/02; A47G 25/54; A47G 25/56; B65D 312/12; B65D 33/02; A47B 96/024; A47B 96/04; A47B 43/003; A47B 43/02; A47B 43/006; A47B 43/00; A47B 43/04; A47B 47/00; A47B 47/06; A47B 61/00; A47B 61/003; A47B 61/04; A47B 61/06; A47B 55/06; A47B 57/406; A47B 57/06; A47B 57/16; A47B 57/20; A47B 57/40; A47B 57/48; A47B 57/482

USPC ..... 211/118, 85.3, 186, 113, 117, 85.2, 211/195, 90.01, 34–38, 10, 103, 72, 135; D6/512–514; 312/3–6; 206/278.1; 383/98

See application file for complete search history.

(56) References Cited

U.S. PATENT DOCUMENTS 937,659 A * 10/1909 Todd ..... 312/5
1,448,539 A * 3/1923 Hopwood ..... 108/164

(Continued)

*Primary Examiner* — Jennifer E Novosad

(74) *Attorney, Agent, or Firm* — Patzik, Frank & Samotny Ltd.

(57) ABSTRACT

Hanging close organizers providing highly rigid and highly stable shelves for supporting shoes and garments are relatively inexpensive to manufacture while, at the same time, provide a relatively large number of potential positions at which the rigid shelves may be securely yet removably positioned. A collapsible fabric body includes a plurality of straps disposed and stitched vertically within the interior of the body. The straps are stitched to the overall body along the majority of the length of each strap. Periodic gaps in the stitching, at horizontally aligned, predetermined positions along the length of each strap, form slots, or slot regions. Each of four horizontal side hooks, disposed proximate an associated corner of a removable shelf, may be advanced axially through an associated slot. A distal protrusion or barb of each side hook serves to further secure each shelf in place, inhibiting unwanted slippage or inadvertent removal of a shelf.

17 Claims, 4 Drawing Sheets

(51) Int. Cl.

| | |
|---|---|
| ***A47G 29/00*** | (2006.01) |
| ***A47B 43/00*** | (2006.01) |
| ***A47B 47/00*** | (2006.01) |
| ***A47B 57/00*** | (2006.01) |
| ***A47B 61/00*** | (2006.01) |
| ***A47B 57/20*** | (2006.01) |
| ***A47B 57/40*** | (2006.01) |
| ***A47B 43/04*** | (2006.01) |
| ***A47B 73/00*** | (2006.01) |
| ***A47B 61/04*** | (2006.01) |
| ***A47B 61/06*** | (2006.01) |
| *A47B 57/16* | (2006.01) |

(56) References Cited

U.S. PATENT DOCUMENTS

| | | | | | |
|---|---|---|---|---|---|
| 1,640,083 | A | * | 8/1927 | Ladd | 211/186 |
| 1,847,066 | A | * | 3/1932 | Berg | 312/6 |
| 2,440,192 | A | * | 4/1948 | Cowan | 312/6 |
| 2,533,333 | A | * | 12/1950 | Kitson | 190/111 |
| 2,639,819 | A | | 5/1953 | Marks | |
| 2,845,185 | A | | 7/1958 | Winderweedle, Jr. | |
| 2,866,559 | A | * | 12/1958 | Byrne | 211/35 |
| 3,184,273 | A | * | 5/1965 | Blough | 312/6 |
| 3,519,318 | A | * | 7/1970 | Hagen | 312/245 |
| 3,669,276 | A | * | 6/1972 | Woods | 211/34 |
| 3,799,072 | A | * | 3/1974 | Slaboden | 108/107 |
| 3,904,258 | A | * | 9/1975 | Faulkenberry | 312/6 |
| 4,329,789 | A | * | 5/1982 | Erickson | 34/195 |
| 4,382,640 | A | * | 5/1983 | Kashden | 312/5 |
| 4,739,809 | A | * | 4/1988 | Adams | 150/112 |
| 5,669,683 | A | * | 9/1997 | Moss et al. | 312/259 |
| 5,713,646 | A | * | 2/1998 | Wang | 312/3 |
| 6,318,822 | B1 | * | 11/2001 | Wang | 312/111 |
| 6,354,232 | B1 | * | 3/2002 | Hulke | 108/149 |
| 6,390,573 | B1 | * | 5/2002 | Wang | 312/6 |
| 6,732,659 | B2 | * | 5/2004 | Poon | 108/42 |
| 6,758,352 | B2 | * | 7/2004 | Gervasi | 211/149 |
| 7,258,232 | B2 | * | 8/2007 | Bradford et al. | 206/386 |
| 7,681,728 | B2 | | 3/2010 | Sabounjian | |
| 7,810,655 | B2 | | 10/2010 | Wang | |
| 8,033,405 | B2 | | 10/2011 | Wang | |
| 8,079,490 | B2 | * | 12/2011 | Nyeboer et al. | 220/552 |
| 8,459,473 | B2 | * | 6/2013 | Wang | 211/118 |
| 8,540,089 | B2 | * | 9/2013 | Wang | 211/118 |
| 8,827,090 | B2 | * | 9/2014 | Kropveld | 211/113 |
| 2005/0140253 | A1 | | 6/2005 | Fu | |
| 2007/0131683 | A1 | * | 6/2007 | Sabounjian | 220/9.1 |
| 2009/0206711 | A1 | * | 8/2009 | Glenn | 312/108 |
| 2010/0133217 | A1 | * | 6/2010 | Wang | 211/118 |
| 2013/0233819 | A1 | * | 9/2013 | Kwo | 211/153 |

* cited by examiner

HANGING CLOSET ORGANIZER WITH RIGID ADJUSTABLE SHELVES

BACKGROUND OF THE INVENTION

1. Field of the Invention

The present invention relates, in general, to closet organizers for the storing of articles of apparel such as shoes and clothing and, more particularly, to closet organizers that are hung from and supported by closet rods or similar cylindrical supports.

2. General Background of the Invention

Closet organizers for supporting and storing shoes and articles of clothing, and that are hung from a closet or similar cylindrical supports, have been known for quite some time. Today, such closet organizers are often collapsible to facilitate their transportation and storage when empty, having a body made of a fabric material and having shelving that is at least semi-rigid, sometimes made of fiberboard or a similar material.

Some prior art closet organizers, such as the one disclosed in U.S. Pat. No. 1,847,066, include a relatively limited number of fabric pockets, or partitions, with each pocket accepting a filler member such as cardboard and creating a plurality of fixed, identically-sized compartments. Such organizers do not provide any user selection of storage compartment height, and are relatively complex in construction, particularly with respect to the attachment of the individual top and bottom portions of each pocket to the fabric shell of the organizer Moreover, the pockets of such organizers may not firmly support the filler members or inserts, leading to compartment bottoms that may sag somewhat when loaded with articles of clothing, particularly heavier garments.

Other prior art closet organizers, such as the one disclosed in U.S. Pub. No. 2005/0140253, include adjustable sized compartments, and removable shelves. Such organizers, however, are relatively complex in construction and relatively expensive to manufacture, as multiple locking strips are required to be attached to the organizer at each potential position that a shelf may be attached.

BRIEF SUMMARY OF THE INVENTION

The present invention provides collapsible closet organizers that overcome many of the shortcomings of certain prior art hanging closet organizers. In particular, hanging closet organizers are disclosed that provide highly rigid and highly stable shelves for supporting shoes and garments. Moreover, hanging close organizers are disclosed that are relatively inexpensive to manufacture while, at the same time, provide a relatively large number of potential positions at which rigid shelves may be securely yet removably positioned.

In the hanging closet organizers of the present invention, a substantially flexible and collapsible fabric body includes a plurality of straps disposed and stitched vertical within the interior of the body. The straps may be stitched to the overall body along the majority of the length of each strap. However, regular, periodic gaps in the stitching, at identical predetermined positions along the length of each strap, serve to form transverse slots facing a front opening of the body, permitting each of four horizontal side hooks, disposed proximate an associated corner of a removable shelf, to be advanced axially from the front opening of the body and through an associated slot. A distal protrusion or barb of each side hook serves to further secure each shelf in place, inhibiting unwanted horizontal slippage or inadvertent removal of a shelf.

Foldable hanger members may be used to suspend the overall collapsible closet organizer from a closet rod or other suitable support. A rigid top cover may also be employed to further maintain the hanger members in a vertical orientation and, aesthetically, to match the general appearance of the removable shelves.

DETAILED DESCRIPTION OF THE INVENTION

Figure 1:
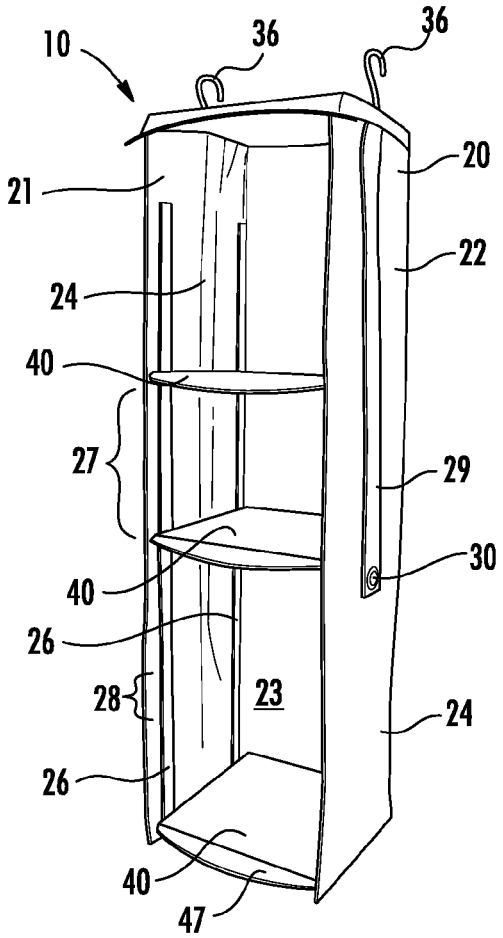
FIG. 1 an elevated, front perspective view of an embodiment of a hanging closet organizer of the present invention.

While the present invention is susceptible of embodiment in many different forms, there is shown in the drawings and will herein be described in detail, several specific embodiments, with the understanding that the present disclosure is intended as an exemplification of the principles of the present invention and is not intended to limit the invention to the embodiments illustrated.

A first embodiment of the present closet organizer 10, sized for the storage of sweaters and similar garments, is shown in FIGS. 1-8 as comprising fabric body 20, a plurality of removable shelves 40, hanger members 32, and top cover 50. Fabric body 20, substantially rectangular in shape (when in its unerected configuration of FIG. 3) includes interior (when fabric body 20 is in its erected configuration of FIGS. 1 and 2) surface 21, exterior (when fabric body 20 is in its erected configuration) surface 22, back wall 23, and two opposing side walls 24. Fabric body may be constructed of a synthetic fabric material, such as a relatively heavy gauge nylon, or a natural fabric material, such as a relatively heavy gauge cotton canvas.

Interior surface 21 of fabric body 20 includes four vertical straps 26, each extending along substantially the entire vertical height of fabric body 20, spaced laterally in pairs such that, when fabric body 20 is erected by creating two vertical folds proximate the inner longitudinal side edges of the two innermost vertical straps 26, the two innermost vertical straps 26 are each disposed at an inner corner of fabric body 20, while the two outermost vertical straps 26 are each spaced inwardly a short distance from the leading edge of side walls 24 at the front opening of the erected fabric body 20. Back wall 23 of fabric body 20 is thus formed in the space between the two vertical folds made proximate the inner longitudinal side edges of the two innermost vertical straps 26.

Figure 3:
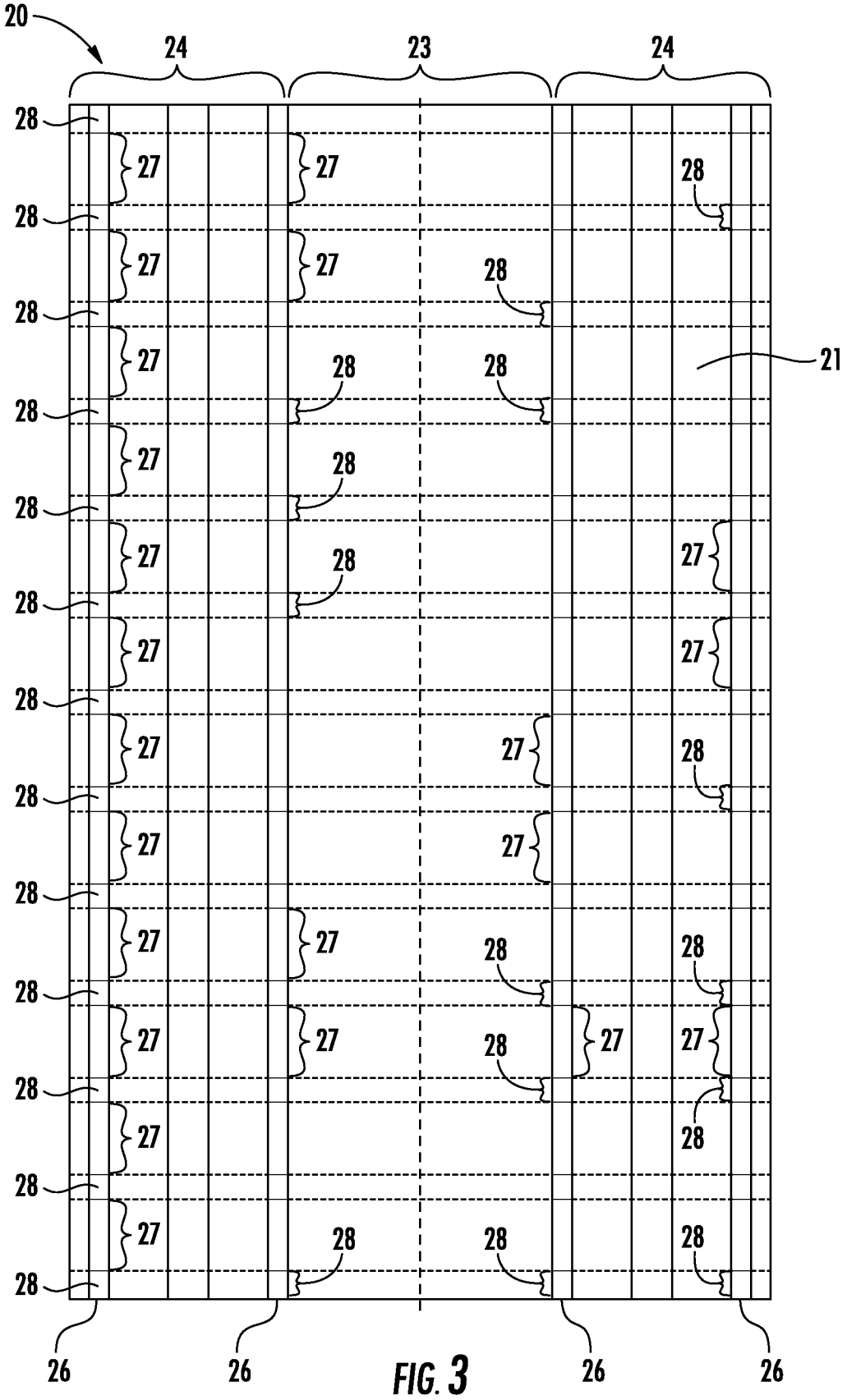
FIG. 3 is a front view of the fabric body component of the hanging closet organizer of FIG. 1, shown in its flat, unerected form.

As best seen in FIG. 3, each vertical strap 26 has an alternating sequence of longitudinal spans of horizontally aligned stitched regions 27, wherein each strap 26 is securely stitched to fabric body 20 using a relatively heavy gauge synthetic or natural thread material, and horizontally aligned unstitched regions 28, wherein no such stitching is present. Accordingly, unstitched regions 28 form horizontal slots, also referred to using reference numeral 28, through which an elongated member, such as horizontal side hooks 45 of removable shelf 40, may be axially inserted and securely held.

Figure 2:
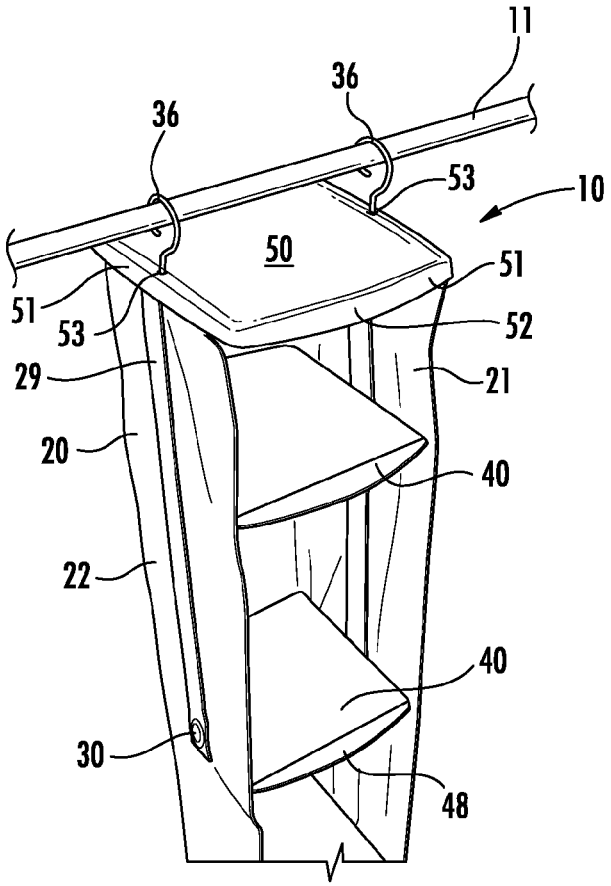
FIG. 2 is an elevated, front perspective view of the hanging closet organizer of FIG. 1, shown suspended from a cylindrical closet rod.

As best in seen in FIGS. 1 and 2, exterior surfaces 22 of both side walls 24 may optionally include an exterior strap 29, extending downwardly from the top edge of each side wall 24. An optional reinforced central aperture 30, reinforced by additional stitching and/or by the placement of additional fabric or a rigid material surrounding the circumference of the aperture, is disposed proximate a distal end of each exterior strap 29, extending through the entire thickness of fabric body 20. Inasmuch as both optional central apertures 30 are axially aligned, a closet rod or other suitable cylindrical support may be extended through both central apertures 30 of multiple units of closet organizer 10, creating a separate, lower hanger-supporting rod between the multiple units 10, well below an upper closet rod by which each of the multiple units 10 are simultaneously hung in a spaced-apart manner.

Figure 4:
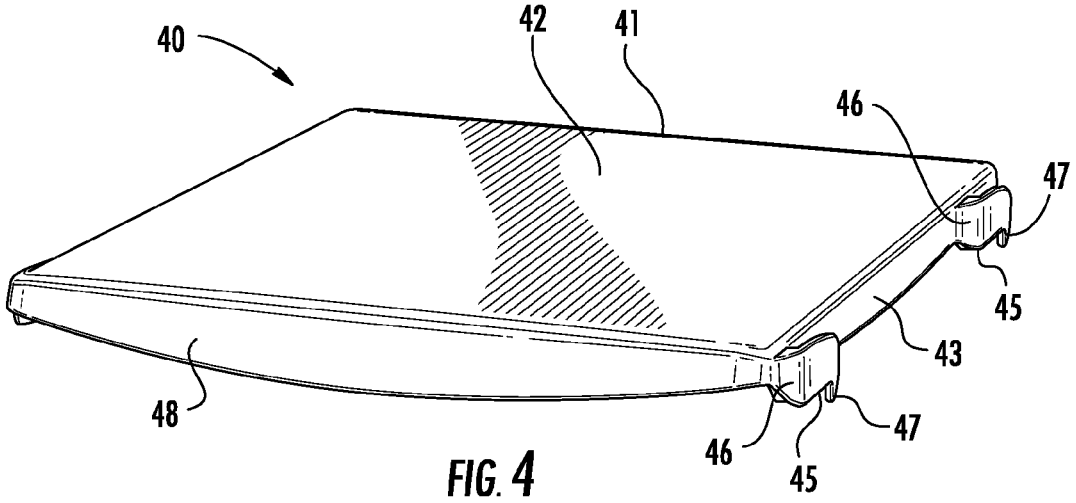
FIG. 4 is an elevated, front perspective view of a removable shelf component of the hanging closet organizer of FIG. 1.
Figure 5:
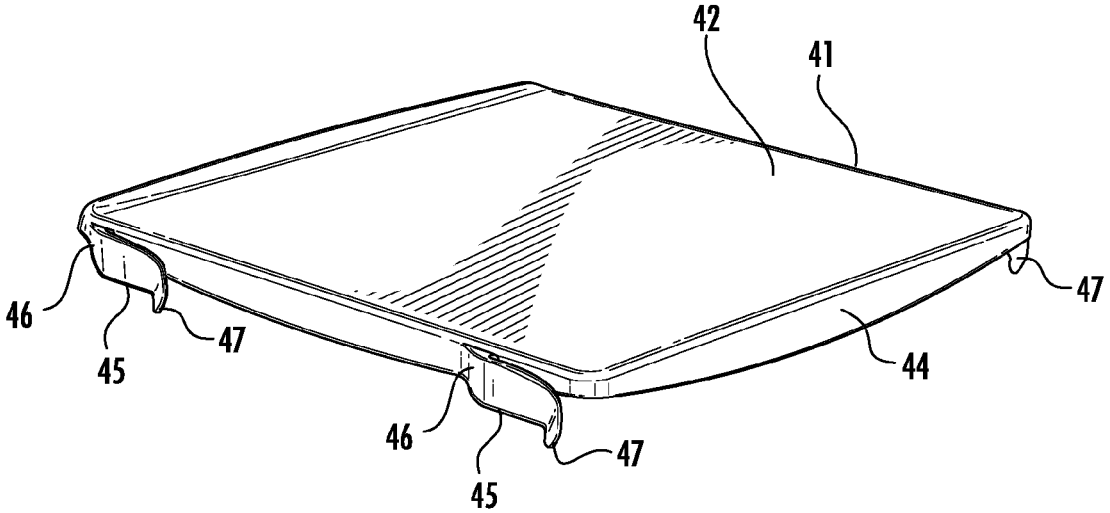
FIG. 5 is an elevated, rear perspective view of the removable shelf component of FIG. 4.
Figure 6:
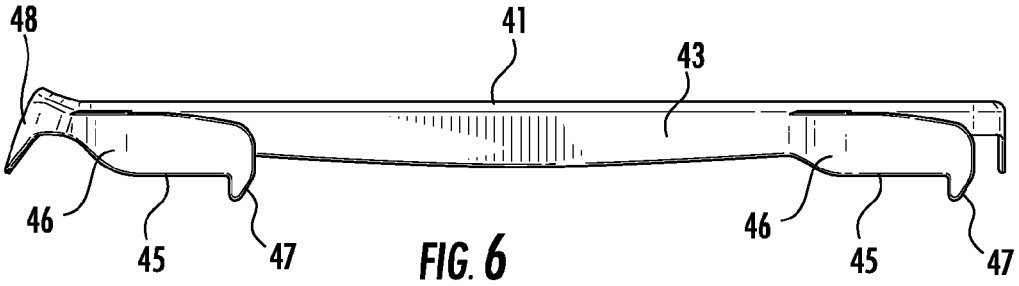
FIG. 6 is an elevated, left side view of the removable shelf component of FIG. 4.

Removable shelf 40, preferably constructed of a substantially rigid material such as polypropylene, is shown in FIGS. 4-6 as comprising body 41 having substantially planar top surface 42, two opposing vertical side edges 43, vertical rear edge 44, and front edge 48. As best seen in FIG. 6, top surface 42 is preferably angled slightly upward proximate front edge 48, serving to facilitate the retention of shoes or garments stored atop removable shelf 40 in place and inhibit them from sliding forward and potentially falling to the floor.

Removable shelf 40 further includes four integrally formed horizontal side hooks 45, respectively disposed proximate the front of left side edge 43, the front of right side edge 43, the rear of left side edge 43, and the rear of right side edge 43. On each side edge 43, two horizontal side hooks 45 are spaced a distance from each other that is substantially equal to the horizontal distance between each parallel pair of vertical interior straps 26 on inner side walls 24 of fabric body 20. Moreover, each horizontal side hook 45 extends from a corresponding side edge 43 of removable shelf 40 from a substantially triangular prism-shaped region 46, securely coupling each side hook 45 to the overall body of removable shelf 40. Each side hook 45 further includes a downwardly-extending protrusion or barb 47 at its distal end. The total height of each side hook 45 at the position of protrusion or barb 47, including the protrusion or barb 47 itself, is preferably only slightly smaller than the height of each slot 28 of fabric body 20 between a pair of opposing stitched regions 27 immediately above and below, serving to firmly secure yet permit the later removal of each removable shelf 40 as its horizontal side hooks 45 are axially inserted through associated slots 28, as discussed further below. This near interference fit of side hooks 45 relative to slots 28 inhibits unwanted forward/backward slippage or unintended removal of an inserted removable shelf 40.

Figure 7:
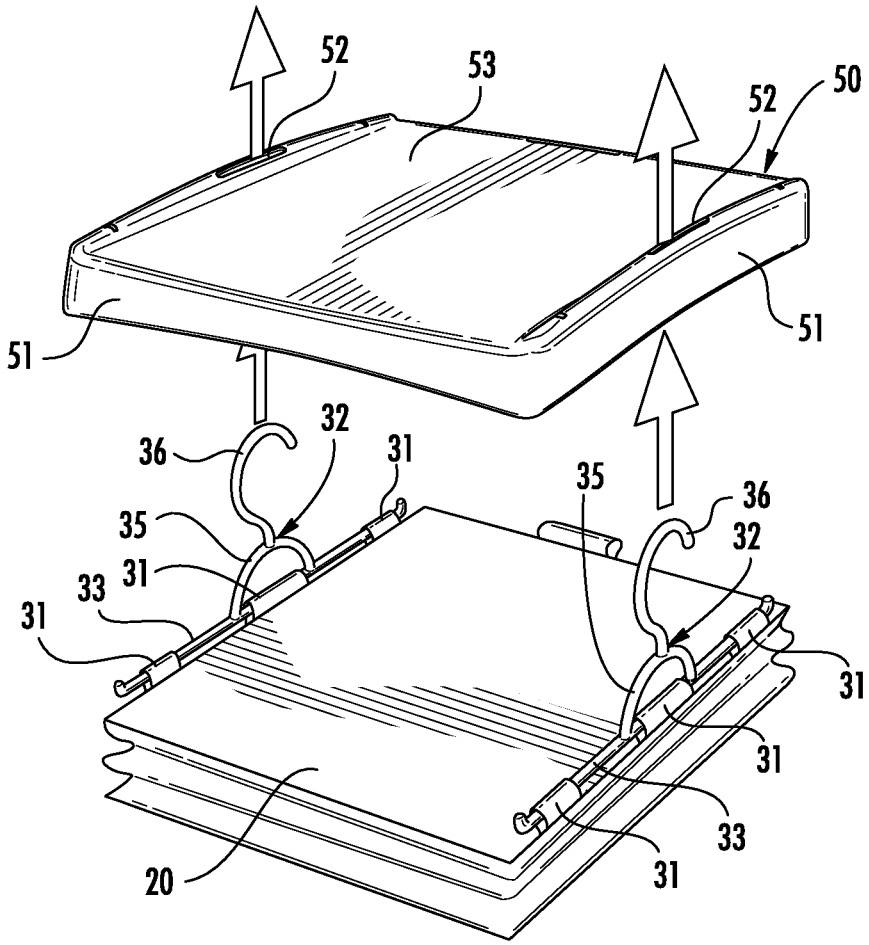
FIG. 7 an exploded, front perspective view of the hanging closet organizer of FIG. 1, showing, in particular, the manner of attachment of the top cover and hanger member to the fabric body.
Figure 8:
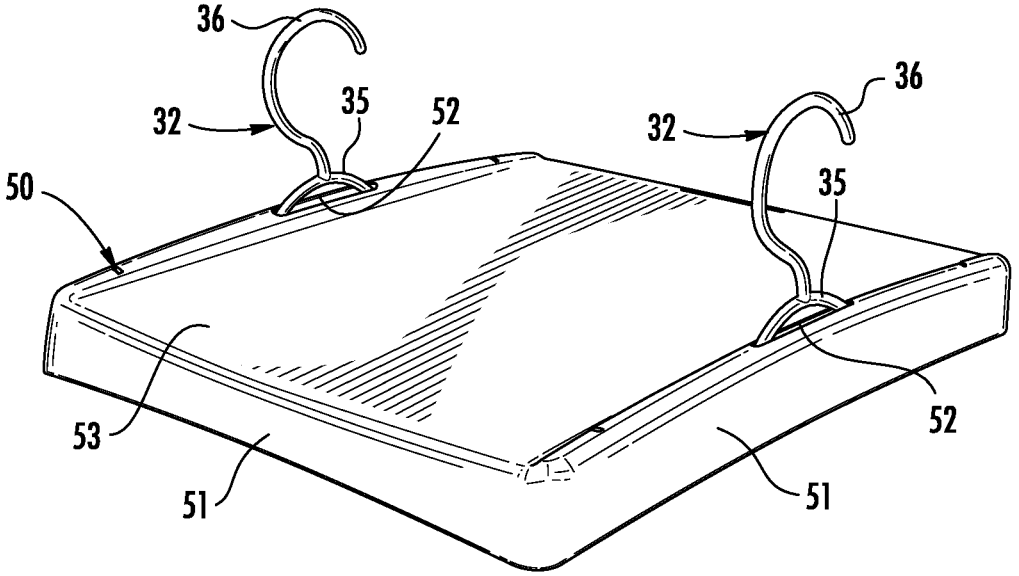
FIG. 8 is a front perspective view of the hanging closet organizer of FIG. 1, showing, in particular, an attached top cover and attached hanger members.

Referring to FIGS. 7 and 8, fabric body 20 further includes a plurality of top loops 31 disposed proximate the top side edges of fabric body 20. On each top side edge, a group of three top loops 31 encircle and substantially surround a horizontal bar 33 of hanger members 32, in sufficiently loose fashion to enable each hanger member 32 to fold or collapse inwardly for storage or shipping of closet organizer 10. Top loops 31 may be sewn in place about hanger member 32, or may employ hook-and-loop or other reclosable fasteners. Hanger member 32 further includes arcuate hook support 35, coupled to and extending from a central portion of horizontal bar 33. Hanging hook 36 extends vertically from arcuate hook support 35, enabling hanging member 32 and, in turn, fabric body 20 and closet organizer 10 overall, to be hung from a closet rod or other suitable support.

Top cover 50 is likewise preferably constructed of a rigid polypropylene material, and is shown in FIGS. 7 and 8 as comprising side edges 51 and two opposing slots 52 extending through top surface 53. Slots 52 are positioned and sized to permit axial insertion therethrough of hooks 36 and an upper portion of arcuate hook supports 35, following attachment of hanging members 32 to fabric body 20, thereby securing hanger members 32 in a vertical orientation relative to fabric body 20 and providing a rigid overall top cover to closet organizer 10. Slots 52 may each include an associated inwardly-directed notched region, permitting each hanger member to be rotated inwardly and thus permitting hooks 36 to be folded flat against top surface 53 for storage or transportation whenever an assembled organizer 10 is not in use.

Closet organizer 10 may be erected and assembled by first creating two vertical folds parallel to and proximate the inner longitudinal side edges of the two innermost vertical straps 26 along the entire length of fabric body 20, such that fabric body is positioned substantially U-shaped or hat-shaped in cross section. This folding step may alternatively be omitted, as the substantially U-shaped or hat-shaped cross section of fabric body 20 may be achieved through the attachment of a removable shelf 40 in the bottom-most position and the attachment of top cover 50 in the manner described below.

Next, a first removable shelf 40 is removably attached to fabric body 20 at the lowermost possible position, by advancing each of four horizontal side hooks 45 of removable shelf 40 through associated front apertures of an associated lowermost slot 28, between a vertical strap 26 and inner surface 21 of fabric body 20, until protrusion or barb 47 is extended through the entirety of an associated slot 28, exiting the rear aperture of the slot and extending downwardly adjacent slot 28. Top cover 50 is then attached to fabric body 20 by extending hooks 36 of hanger member 32 through slots 52 until top cover 50 is firmly seated adjacent top loops 31 and horizontal bar 33 of hanger members 32.

Finally, a desired number of additional instances of removable shelves 40 may be removably attached to fabric body at respective desired heights, by selecting a set of four unused slots 28 at the desired height, advancing each of four horizontal side hooks 45 of a removable shelf 40 through associated front apertures of an associated one of a set of four slots 28 at the desired height, between a vertical strap 26 and inner surface 21 of fabric body 20, until protrusion or barb 47 is extended through the entirety of an associated slot 28, exiting the rear aperture of the slot and extending downwardly adjacent slot 28. In this manner, a wide variety of individual compartment configurations, having a wide variety of compartment heights, may be selected and created by the user.

Following insertion of a desired number of removable shelves 40 at desired positions as discussed above, any previously inserted removable shelf 40 may be removed from attachment to fabric body 20 by pulling shelf 40 outwardly, stretching or manipulating each of the associated slots 28 as each protrusion or barb 47 of each horizontal side hood 45 passes axially and relatively tightly through the slot 28.

In the embodiment of FIGS. 1-8, fabric body 20, removable shelves 40, and top cover 50 are all sized to accommodate the organization and storage of folded sweaters or similarly sized garments. In this embodiment, fabric body 20, removable shelves 40, and top cover 50 may all be sized to provide an organizer 10 that is approximately twelve inches wide when fully assembled.

In another embodiment of the invention, fabric body 20, removable shelves 40, and top cover 50 are all sized to accommodate the organization and storage of pairs of shoes or similarly sized articles of apparel. In this embodiment, fabric body 20, removable shelves 40, and top cover 50 may all be sized to provide an organizer 10 that is approximately seven inches wide when fully assembled.

Many modifications and variations of the present invention are possible in light of the above teachings. It is therefore to be understood that within the scope of the appended claims, the invention may be practiced other than as specifically described. Various modifications, changes and variations may be made in the arrangement, operation and details of performing the various steps of the invention disclosed herein without departing from the spirit and scope of the invention. The present disclosure is intended to exemplify and not limit the invention.

What is claimed is:

1. A closet organizer, comprising:

a body constructed of a substantially flexible material, the body having a left side and a right side, each of the left side and right side of the body having an interior surface and a plurality of slots disposed proximate the interior surface of the left side and the interior surface of the right side of the body;

a plurality of straps of substantially flexible material, each strap being only partially affixed to at least a portion of the interior surface of the body and comprising a repeating sequence of longitudinal regions alternating between first regions wherein the strap is affixed to the interior surface of the body, and second regions wherein the strap is adjacent to and is not affixed to the interior surface of the body, each of the plurality of slots being formed at a location of a lack of affixation between one of the plurality of straps and the interior surface of the body at an associated second region; and at least one substantially rigid removable shelf having a plurality of hook members, each of the hook members being sized and configured to be insertable through at least a portion of a corresponding slot, the removable shelf being supported in position by the hook members and the associated slots following insertion of each of the hook members through at least a portion of a corresponding slot.

2. The closet organizer according to claim 1, wherein at least two of the plurality of slots are horizontally aligned along at least one of the left side and the right side of the interior surface of the body.

3. The closet organizer according to claim 1, wherein at least two of the plurality of slots are vertically aligned on the left side and the right side of the interior surface of the body.

4. The closet organizer according to claim 1, wherein at least one of the straps is attached to the body using alternating stitched regions and unstitched regions, the stitched regions being the first regions and the unstitched regions being the second regions.

5. The closet organizer according to claim 1, wherein the plurality of straps comprises at least four straps, two of the straps being disposed along the interior surface of the left side of the body and two of the straps being disposed along the interior surface of the right side of the body.

6. The closet organizer according to claim 1, wherein the plurality of slots comprises a plurality of groups of vertically aligned slots, each of the slots within a group of vertically aligned slots being positioned for axial insertion of at least a portion of an associated hook member of a removable shelf.

7. The closet organizer according to claim 1, wherein the at least one of the substantially rigid removable shelf includes a left side and a right side, at least one of the hook members being disposed proximate the left side of the removable shelf and at least one of the hook members being disposed proximate the right side of the removable shelf.

8. The closet organizer according to claim 7, wherein the at least one of the substantially rigid removable shelf includes at least four hook members, at least two of the hook members being disposed proximate the left side of the removable shelf and at least two of the hook members being disposed proximate the right side of the removable shelf.

9. The closet organizer according to claim 8, wherein the body includes at least four slots, two of the slots being disposed proximate the left side of the interior surface of the body and having a spacing therebetween substantially corresponding to a spacing between the two hook members disposed proximate the left side of the shelf, and two of the slots being disposed proximate the right side of the interior surface of the body and having a spacing therebetween substantially corresponding to a spacing between the two hook members disposed proximate the right side of the removable shelf.

10. The closet organizer according to claim 1, wherein at least one of the hook members is disposed longitudinally adjacent at least a portion of a side edge of the at least one removable shelf.

11. The closet organizer according to claim 1, wherein at least two of the hook members are disposed longitudinally adjacent at least a portion of one side edge of the at least one removable shelf.

12. The closet organizer according to claim 11, wherein a spacing between the at least two hook members disposed longitudinally adjacent at least a portion of one side edge of the at least one removable shelf substantially coincides with a spacing of at least two slots disposed proximate one side of the interior surface of the body.

13. The closet organizer according to claim 1, wherein at least one of the hook members further includes a downwardly extending protrusion proximate a distal end of the hook member, the protrusion serving to releasably secure at least a portion of the hook member within an associated slot following insertion of at least a portion of the hook member into the slot.

14. The closet organizer according to claim 1, further comprising at least one hanging hook operably coupled to the body and hangable from a cylindrical rod.

15. The closet organizer according to claim 1, further comprising a substantially rigid top cover attachable to the body.

16. The closet organizer according to claim 1, wherein the body further includes a first aperture disposed through a portion of the left side of the body and a second aperture disposed through a portion of the right side of the body, the first and second apertures being aligned vertically and sized to permit a cylindrical closet rod to be axially inserted therethrough.

17. The closet organizer according to claim 16, wherein the body further includes additional reinforcing material proximate a circumference of at least one of the first aperture and the second aperture.

* * * * *